United States Patent [19]

Martin et al.

[11] 4,402,169

[45] Sep. 6, 1983

[54] SURFACING FOR ROOF AND SIDING STRUCTURES OF BUILDINGS

[75] Inventors: Otis M. Martin, 5624 Bodie Ct., San Jose, 95123; John K. Kough, Morgan Hill, Calif.

[73] Assignee: Otis M. Martin, San Jose, Calif.

[21] Appl. No.: 175,539

[22] Filed: Aug. 5, 1980

[51] Int. Cl.[3] ..... E04D 1/20; E04D 1/36

[52] U.S. Cl. ..... 52/540; 52/554; 52/748

[58] Field of Search ..... 52/540, 530, 543, 550, 52/551, 552, 553, 554, 748

[56] References Cited

U.S. PATENT DOCUMENTS

| | | | |
|---|---|---|---|
| Re. 27,502 | 10/1972 | Martin | 52/94 |
| 2,062,149 | 11/1936 | Stark et al. | 52/540 X |
| 2,130,178 | 9/1938 | Elmendorf | 52/540 |
| 3,626,651 | 12/1971 | Kough et al. | 52/536 |
| 3,664,081 | 5/1972 | Martin et al. | 52/540 |
| 3,696,570 | 10/1972 | Kough et al. | 52/127 |
| 3,731,438 | 5/1973 | Kough et al. | 52/13 |
| 3,760,856 | 9/1973 | Kough et al. | 144/323 |
| 3,771,271 | 11/1973 | Keel | 52/540 X |
| 3,785,114 | 1/1974 | Kough et al. | 52/748 |
| 3,841,050 | 10/1974 | Martin | 52/745 |
| 3,844,082 | 10/1974 | Martin et al. | 52/540 |
| 3,919,822 | 11/1975 | Martin et al. | 52/540 |

*Primary Examiner*—J. Karl Bell

*Attorney, Agent, or Firm*—Jack M. Wiseman; Francis W. Anderson

[57] ABSTRACT

A panel construction for surfacing roof or siding structures of a building. Each panel is made of flexible composition and as applied, its lower horizontal edge is associated with a strip that provides a distinct shadow line.

2 Claims, 10 Drawing Figures

SURFACING FOR ROOF AND SIDING STRUCTURES OF BUILDINGS

BACKGROUND OF THE INVENTION

This invention relates generally to the surfacing of roof and siding structures of buildings, and particularly to the construction and arrangement of panels for such surfacing.

In the past, various materials and panel constructions have been used for surfacing roof and siding structures of buildings. Particular reference can be made to common wood shingles and shakes that are generally applied over a waterproof membrane (e.g., tar paper) and secured to underlying sheathing. Another common type of surfacing consists of shingles made of flexible composition which are likewise secured to underlying sheathing. Composition shingles or panels have the advantage that they can be applied over existing roofing (e.g., over composition or wood shingles), due to their flexibility. However, the surfacing that they provide lacks aesthetic qualities, particularly in that their dimensions are such that when applied in overlapping rows, their lower edges do not provide a distinct shadow line comparable to a wooden shake roof. Some roofing panels (e.g., U.S. Re. 27,502) have been made that are intended primarily for new structures, and which include both structural sheathing (e.g., plywood) and roof surfacing (e.g., wood shakes). However, such panels are not economically feasible for applying a roof surfacing over an existing roof.

SUMMARY OF THE INVENTION AND OBJECTS

It is an object of the present invention to provide a roofing or siding surfacing which is relatively inexpensive and which can be used for either new or old roof or sliding structures.

Another object is to provide an inexpensive roofing or siding surfacing which makes use of flexible composition material and which provides good aesthetic properties. Particularly, the construction and assembly of the panels is such that when applied as a new surfacing on sheathing or as a new surfacing over an existing surfacing (wood or composition shingles), aesthetically attractive shadow lines are provided at the lower edges of the panels.

In general, panels constructed in accordance with the present invention comprise strips of flexible waterproof surfacing composition having upper and lower horizontal margins when applied horizontally to a building structure. Each panel when assembled with a next lower like panel has its lower margin overlapping the upper margin of the next lower panel, and shadow line forming strip means is disposed in the region of these margins. The strip means is so constructed and dimensioned that it serves to impart a distinct shadow line along the lower horizontal edge of the panel. The shadow line strip means extends for the length of the panel and has a width substantially less than the width of the panel.

Additional objects and features of the invention will appear from the following description in which the preferred embodiments have been set forth in detail in conjunction with the accompanying drawings.

DESCRIPTION OF THE PREFERRED EMBODIMENTS

Figure 1:
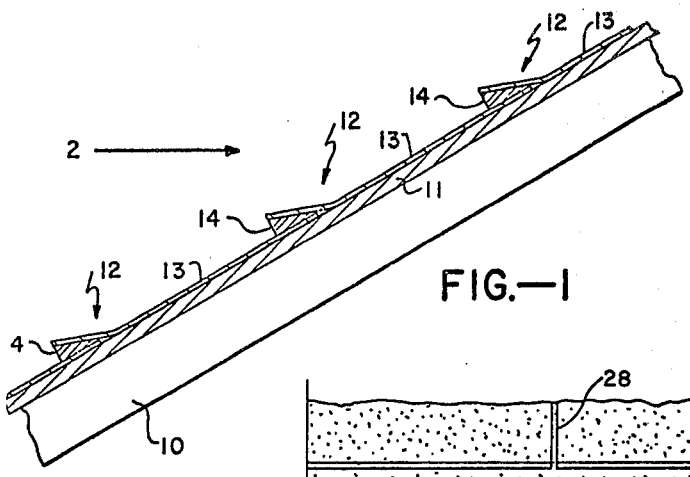
FIG. 1 is a side elevational view in section showing a roof structure surfaced in accordance with the present invention.

The roofing structure shown in FIG. 1 consists of the rafters 10 to which the sheathing 11 is secured. The sheathing may be conventional and, for example, may consist of plywood or sheathing boards. The surfacing for this structure consists of panels 12 that are secured to the sheathing 11 and arranged in horizontal overlapping rows. The panels can be any convenient length, as for example from 4 to 8 feet. Each panel consists of a strip 13 of suitable flexible composition, such as compositions consisting of asbestos or other fiber together with a flexible bonding agent, such as asphalt or suitable resin. In the region of the overlapping margins of the composition strips, there are shadow line forming strips 14 which can be made of wood or like inexpensive material. The strips 14 extend for the length of the composition strips 13, but their width is a minor fraction of the width of the composition strips.

Figure 3:
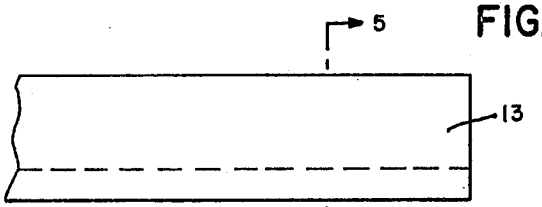
FIG. 3 is a plan view showing a portion of a panel with a shadow line strip secured to one margin.
Figure 4:
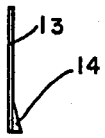
FIG. 4 is an end view of the panel shown in FIG. 3.
Figure 5:
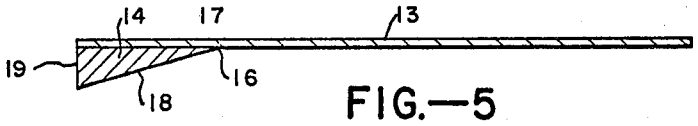
FIG. 5 is a cross-sectional view taken along the line 5—5 of FIG. 3, on an enlarged scale.

FIGS. 3–5 show one form of panel in which the shadow line forming strip is attached to one margin of the composition strip before the panels are applied to the roof. As shown particularly in FIG. 5, the shadow forming strip 14 is wedge-shaped or triangular in section. Thus, it has a thinner apex edge 16 and an inner side 17 that is secured as by means of a suitable adhesive to the corresponding margin of the composition strip 13. Also it has a lower side 18 which is adapted to overlap the upper margin of the next lower panel, and an edge face 19 of substantial thickness which is exposed at the lower edge of the panel and which provides the desired shadow line.

By way of example, the composition strip may be 12 inches in width and 4 feet in length. Strip 14 may be $3\frac{1}{2}$ inches wide, $\frac{1}{8}$ inch thick at its apex edge, and $\frac{3}{4}$ inch thick at its shadow line edge 19.

When the panels as shown in FIGS. 3–5 are assembled to make a roof surfacing or a surfacing for a sliding, the panels are disposed in overlapping horizontal rows, or in other words, the shadow forming strip 14 for one panel is arranged whereby it overlaps the upper margin of the next lower panel. Suitable means such as adhesive, fasteners or nails are applied to secure the composition to the underlying sheathing and to secure the strips 14 to the underlying margin of the next lower panel.

Panels as shown in FIGS. 3–5 can be manufactured and supplied in flat form ready for application to a roof structure of a building. A pressure sensitive adhesive can be pre-applied to the under side of the composition and to the side surface 18 of the strip 14, or suitable mastic, adhesive or nails can be applied at the time the panels are assembled on the roof structure. If the roofing is to be assembled upon a preexisting shingle roof, the shingles may first be surfaced with a waterproof membrane, such as tar paper or felt, and a row of composition strips 13 laid along a starting area. Then a row of strips 14 can be applied as by nails over the upper margin of the composition strips. Thereafter the next upper row of composition strips is applied with their lower margins overlapping the strips 14 and secured thereto as by use of suitable means such as mastic, adhesive or nails. By proceeding in this manner the entire roof area can be covered with the composition strips and strip 14 arranged as shown in FIG. 1.

With the construction shown in FIG. 5, it is desirable to provide a suitable protective coating for the face 19, as for example a suitable paint or sealant which will provide a shadow appearance.

While the use of a waterproof membrane between the new roof surfacing and the old is not essential, it tends to provide a smoother water resistant surface over which the new composition surfacing can be applied.

Figure 6:
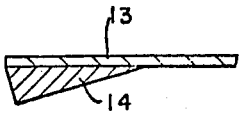
FIG. 6 is a detail in section showing one manner in which the composition material can be secured to the shadow strip.

Assuming that the shadow line forming strips 14 are secured to the composition strips before being assembled in a roof, the attachment can be made in various ways, in addition to the arrangement shown in FIGS. 3–5. In the construction shown in FIG. 6 the same type of shadow line forming strip is employed, but the strip is inverted so that the hypotenuse of the triangular configuration is secured to the corresponding margin of the composition strip 13. This provides an end face which in the completed assembly extends in a plane substantially at right angles to the general plane of the roof.

Figure 7:
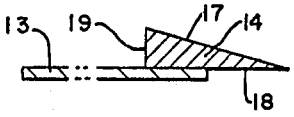
FIG. 7 is a detail in section on an enlarged scale showing the shadow line strip attached to the upper margin of the composition panel.

As illustrated particularly in FIG. 7, it is possible to attach the shadow line forming strip 14 to the upper margin of the composition strip rather than to the lower margin as previously described. Thus, as shown in FIG. 7 the lower side surface 18 of the shadow line forming strip 14 is secured as by use of adhesive to the upper margin of the composition strip 13. When such a panel is assembled with like panels to form a roof surfacing, the strips 14 can be secured as by nailing to the underlying sheathing and the lower margin of the next upper panel is secured to the upper side of the strip 14.

Figure 8:
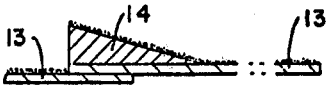
FIG. 8 is an enlarged detail like FIG. 7 showing another embodiment in which the shadow strip is secured to the lower margin of a composition strip.

The shadow line forming strip may also be applied over the lower margin of the composition strip. Thus as shown in FIG. 8, the shadow strip 14 overlies and is adhesively secured to the lower margin of the composition strip 13. Assuming that the shadow strip is made of wood, it can be treated with suitable materials to inhibit water penetration and deterioration, and its upper surface can be coated to provide a finish that is visually compatible with the upper surface of the composition strip. For example, where the composition has a surfacing of fine stone chips, pebbles or sand, the strip 14 can be finished in the same manner. In assembling the panels shown in FIG. 8, they are secured to the underlying sheathing and overlapping portions are secured together by suitable means.

Figure 9:
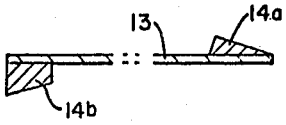
FIGS. 9 and 10 are enlarged details in section showing another embodiment in which two strip portions are employed.
Figure 10:
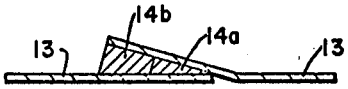

The shadow strip may be in two parts which provide the desired shadow line when panels are assembled. Thus as shown in FIGS. 9 and 10, instead of one wedge-shaped strip for each panel, two strip portions **14*a* and 14*b* are provided. The configuration of these strip portions in section is such that when assembled as in FIG. 10, they form a composite strip with a combined wedge-shaped configuration. In assembling such panels the strip portions 14*a*** can be secured to underlying sheathing as by nailing.

Figure 2:
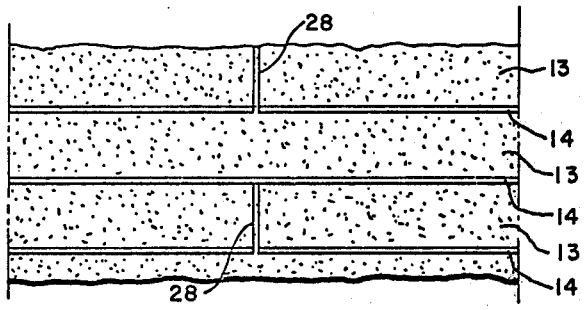
FIG. 2 is a side elevational view of the structure shown in FIG. 1, as viewed from the direction indicated in FIG. 1.

In all of the panel constructions described above, provision should be made whereby when laid end to end in the manner illustrated in FIGS. 1 and 2, leakage does not occur at the lines of junction 28 between the ends of adjacent panels. Such leakage can be avoided in several ways, as for example by applying mastic beneath these areas.

In general, it will be evident that the panel construction and the arrangement of the panels to form a roof surfacing provides an attractive roof with distinct shadow lines. At the same time the panels are relatively inexpensive and because of the flexibility of the composition material, they can be applied to existing roofs as well as new roof structures.

We claim:

1. A surfacing arrangement for a roof or siding comprising a first strip of surfacing composition material having upper and lower horizontal margins when applied horizontally to a building structure; an elongate shadow-line forming member disposed over the upper surface of said first strip at the upper margin of the strip, said member having a flat inner wall in face-to-face contact with said strip, an end wall extending outwardly from said strip generally normal thereto, and an outer wall projecting away from the outer edge of said end wall; and a second strip of the same composition material as said first strip and having a lower margin in face-to-face contact with the outer wall of said elongate member and terminating at the outer edge of said end wall, the end wall of said shadow-line member being arranged to extend continuously between said outer and inner strips and being made of a material different from said composition material.

2. The arrangement of claim 1 wherein said elongate shadow-line forming member is generally triangular in cross-section with said outer and inner walls converging toward an apex, and said end wall is disposed remote from the apex and is completely exposed to view between said first roofing strip underlying the inner wall and said second roofing strip secured to the outer wall of the elongate member, said second roofing strip being in close continuous contact with the outer wall of the member from the apex to the edge where the end wall and the outer wall of the shadow-line member meet.

* * * * *